US009943105B2

(12) United States Patent
Romanazzi

(10) Patent No.: US 9,943,105 B2
(45) Date of Patent: Apr. 17, 2018

(54) ASHTRAY DEVICE FOR SEPARATING ASH AND BUTTS

(71) Applicant: R.A.S.T. S.R.L., Rome (IT)

(72) Inventor: Pasquale Romanazzi, Monterotondo (IT)

(73) Assignee: R.A.S.T. INDUSTRY'S SRL, Rome (IT)

( * ) Notice: Subject to any disclaimer, the term of this patent is extended or adjusted under 35 U.S.C. 154(b) by 23 days.

(21) Appl. No.: 15/028,106

(22) PCT Filed: Oct. 9, 2014

(86) PCT No.: PCT/IB2014/065174
§ 371 (c)(1),
(2) Date: Apr. 8, 2016

(87) PCT Pub. No.: WO2015/052674
PCT Pub. Date: Apr. 16, 2015

(65) Prior Publication Data

US 2016/0242462 A1 Aug. 25, 2016

(30) Foreign Application Priority Data

Oct. 10, 2013 (IT) ..... RM2013A0554

(51) Int. Cl.

| | |
|---|---|
| ***B07B 13/00*** | (2006.01) |
| ***A24F 19/00*** | (2006.01) |
| ***A24F 19/02*** | (2006.01) |
| ***A24F 19/10*** | (2006.01) |
| ***B65F 1/00*** | (2006.01) |

(52) U.S. Cl.
CPC ..... *A24F 19/005* (2013.01); *A24F 19/00* (2013.01); *A24F 19/0021* (2013.01); *A24F 19/0071* (2013.01); *A24F 19/02* (2013.01); *A24F 19/10* (2013.01); *B07B 13/00* (2013.01); *B65F 1/0053* (2013.01); *B65F 2210/104* (2013.01); *B65F 2210/12* (2013.01); *B65F 2210/129* (2013.01); *B65F 2210/176* (2013.01); *B65F 2240/104* (2013.01); *B65F 2240/108* (2013.01); *B65F 2240/145* (2013.01); *B65F 2240/156* (2013.01)

(58) Field of Classification Search
CPC ..... B07B 13/05; A24F 19/00; A24F 19/0021; A24F 19/005; B65F 1/0053; B65F 2210/12; B65F 2210/129; B65F 2210/176; B65F 2240/104
USPC ..... 209/658
See application file for complete search history.

(56) References Cited

U.S. PATENT DOCUMENTS 958,164 A * 5/1910 Parker ..... B07B 13/05 209/654
2,715,977 A * 8/1955 Allman ..... A24F 19/00 126/376.1
3,412,855 A * 11/1968 Nilmeier ..... B07B 13/05 209/661

(Continued)

*Primary Examiner* — Joseph C Rodriguez
(74) *Attorney, Agent, or Firm* — Ableman, Frayne & Schwab

(57) ABSTRACT

An ashtray device (1) for collecting cigarette or cigar ash and butts, the device comprising a separation mechanism (2) for separating the ash from the butts, and at least two containers (10, 11), wherein a first container (10) is positioned so as to receive the butts and a second container (11) is positioned so as to receive the ash.

17 Claims, 4 Drawing Sheets

(56) References Cited

U.S. PATENT DOCUMENTS

| | | | | | |
|---|---|---|---|---|---|
| 3,606,144 | A * | 9/1971 | Ginsberg | A24F 19/0021 | 232/1 R |
| 4,221,035 | A * | 9/1980 | Thatcher | A24C 5/36 | 209/129 |
| 4,635,649 | A * | 1/1987 | Zanello | A24F 19/0021 | 131/231 |
| 4,776,467 | A * | 10/1988 | Hayasaki | B07C 5/06 | 209/620 |
| 9,199,281 | B2 * | 12/2015 | Fourney | B65G 17/24 | |
| 9,623,421 | B2 * | 4/2017 | Bolla | B02C 17/1855 | |
| 9,694,393 | B2 * | 7/2017 | Mueller | B07B 13/075 | |

* cited by examiner

ASHTRAY DEVICE FOR SEPARATING ASH AND BUTTS

CROSS REFERENCE TO RELATED APPLICATION

This application claims benefit under 35 U.S.C. § 371 to international application No. PCT/IB2014/065174, filed on Oct. 9, 2014, which claims priority to Italian application no. RM2013A000554, filed Oct. 10, 2013, the contents of which are incorporated by reference in their entireties.

FIELD OF THE INVENTION

The present invention relates to an ashtray device for collecting cigarette or cigar butts, which is also capable of separating the butts from the ash.

STATE OF THE ART

The butt or stub is what remains of a cigarette or of a cigar after its use. Despite their innocuous appearance, butts are the cause of major ecological problems both in the field of waste management and in the field of forestry management.

Such problems are particularly related to the common custom of dispersing them in the urbanized and natural environments; this apparently harmless habit has major environmental repercussions.

In addition to ecological issues, the distribution and ubiquity of butts in public spaces may also be perceived as an unpleasant sign of environmental and urban neglect, second only to leaving feces on streets.

Furthermore, aspects related to hygiene and health gain importance in relation to the risk of intoxication by ingestion, particularly by children, when butts are left in public spaces frequented by children, such as playground and other areas reserved to them. Infants may easily come into contact with the butts left in these places, as those which litter beaches for various reasons, and consequently put them into their mouths, with risks of intoxication.

With regards to ecological problems in stricter sense, butts are waste and represent, from the merely numeric point of view, the most numerous fraction of the waste produced every year in the world. From the point of view of environmental safety, butts are hazardous waste even when disposed properly. A butt generally consists of a filter (a cylinder made of synthetic fiber—cellulose acetate—covered with colored paper), some tobacco remnants and scraps of the paper in which it is rolled, partially consumed and burnt, together with ash remains. Sometimes, the filter may be slightly burnt. After having been consumed, the constitutive elements of the butt (filter, paper, tobacco) remain impregnated with the substances which they are intended to filter and retain.

The latency time in nature before complete decomposition varies from six months to at least a dozen of years, according to environmental conditions and cigarette type (filter-less or with filter). The biodegradability of the filter itself, i.e. the element coming from a cigarette which has not been smoked, is questionable: the synthetic fiber of which the filter is made is not biodegradable, but can only be reduced to fine powder, incidentally in a time of 10-15 years, at the end of which, in all case, a fine synthetic residue remains, which is distributed in soil and water simply being "diluted" into the environment without ever "vanishing".

With regards to longevity, it must be said that filtered butts do not come undone even when submerged in water; instead, they float on the surface and can be easily carried: if thrown into toilets or sewer drains they can cause obstructions and faults to pipes and pumps. As a preventive measure, specific grids are installed at the entrance of water treatment systems to retain butts and other objects of similar solid consistency. Continuous maintenance is needed to keep such filters effective, which is an additional cost in the industrial waste water treatment cycle.

In all cases, the problems become worse when the butt of a smoked cigarette is considered instead of the filter itself. Indeed, potential sources of problems are the harmful substances which are accumulated in it, including heavy metals, which come from the filter of the smoked cigarette and from the residual tobacco of filter-less cigarette butts. Indeed, unfiltered cigarette smoke consists of gas and particulate in suspension, a mixture which contains more than 4000 chemical substances, which are classified, according to the cases, as irritant, harmful, toxic, mutagenic and carcinogenic. In fact, at least 250 of such substances are considered harmful, and at least 50 are recognized carcinogens. Of the substances at risk, the most well known are carcinogens, such as benzopyrene, phenol and formaldehyde; heavy metals, such as arsenic, lead and cadmium; toxic substances, such as acetone, toluene, nicotine, benzene, hydrogen cyanide, acetaldehyde, nitrates; dangerous substances, such as butane and ammonia.

The problem arises from the release and dispersion into the environment of these substances by means of the diffused micro-pollution caused by the enormous mass of abandoned butts. Water pollution is a problem since most of the butts are exposed to water. Furthermore, a fraction of the butts ends up in sewer canals, while another fraction is easily carried by runoff and reaches rivers.

The phenomenon of abandoning butts, and that of their accumulation, may be mitigated by disseminating suitable receptacles, such as ashtrays, made available to the customers of shops or patrons of a venue, while the disposal in trashcans, garbage bins or containers for ordinary waste is considered inappropriate, because the residual lighting may cause fires.

However, the current receptacles for collecting butts, usually comprising a container full of sand in which to place the butts, is not very hygienic or pleasant to the sight and to the smell. Indeed, it is often very easy to foul ones hands when stubbing out a cigarette in these containers. Furthermore, a bad smell coming from the partially burnt butts, which are impregnated with harmful substances, can be perceived.

A first improving solution is provided by U.S. Pat. No. 3,606,144 A, which describes an ashtray provided with an electrically powered conveyor belt to carry the ash and the butts together into a same receptacle.

A second improving solution is provided by U.S. Pat. No. 2,715,977 A that describes an ashtray which can separate the ash from the butts. However, the efficiency of such an ashtray is not sufficiently adequate and its actuation is manual, and thus a level of hygiene and automation, which would be advantageous instead, is not provided.

It is thus felt the need to make an ashtray device which allows to overcome the aforesaid drawbacks.

SUMMARY OF THE INVENTION

The main object of the present invention is to make an ashtray device which allows a more effective, hygienic collection of cigarette and cigar butts with respect to the solutions already present on the market.

Another object of the invention is to make a self-cleaning ashtray device which automatically allows to separate the ash from the butts, allowing a downstream differentiated treating by type of waste.

The present invention thus aims to reach the aforesaid objects by making an ashtray device which, in accordance with claim 1, comprises a separation mechanism for separating the ash from the butts; and at least two containers, wherein a first container is positioned so as to receive the butts and the second container is positioned so as to receive the ash; the ashtray device being characterized in that said separation mechanism comprises:

- a conveyor belt which can be actuated alternatively in a first direction X and then in a second direction Y, opposite to the first direction X,
- and a fixed separator element, arranged over said conveyor belt and cooperating therewith so that, when the conveyor belt moves in said first direction X, the fixed separator element lets the ash pass through and stops the butts.

The ashtray device of the invention can include, in different variants of its structure, some optional equipment, such as:

- an atomizing system for eliminating possible bad smells;
- a container for collecting chewing-gum and/or sweets and disposable tissue dispenser;
- a container for collecting paper;
- a container for collecting plastic and/or aluminum;
- a container for collecting expired pharmaceuticals, if the device is used near pharmacies;
- a container for collecting used batteries and/or light bulbs.

The dependent claims describe preferred embodiments of the invention.

BRIEF DESCRIPTION OF THE FIGURES

Further features and advantages of the invention will be more apparent in light of the detailed description of a preferred, but not exclusive, embodiment, of an ashtray device illustrated by way of non-limitative example, with the aid of the accompanying drawings, in which.

Figure 1B:
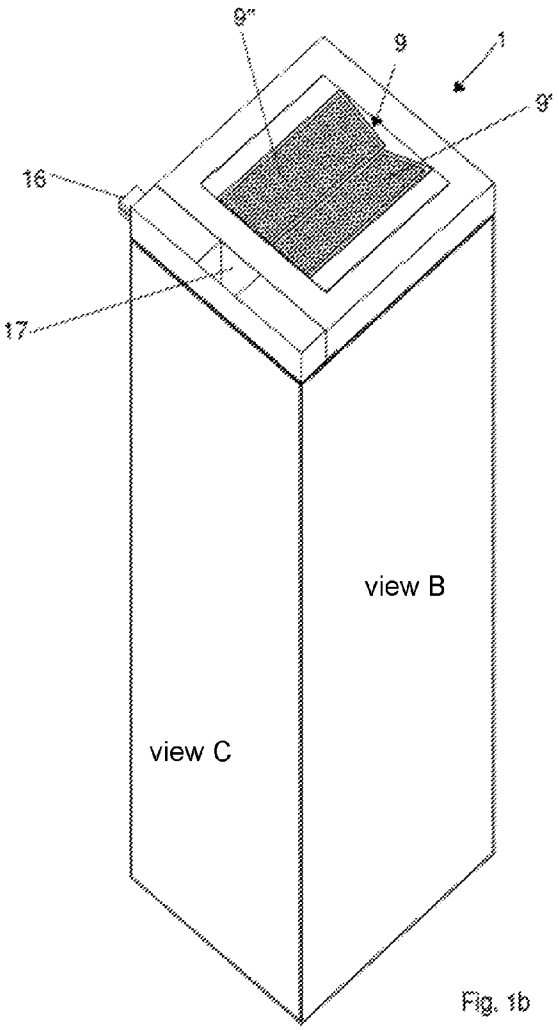
FIGS. 1*a* and 1*b* are two perspective views of the device according to the invention.
Figure 1A:
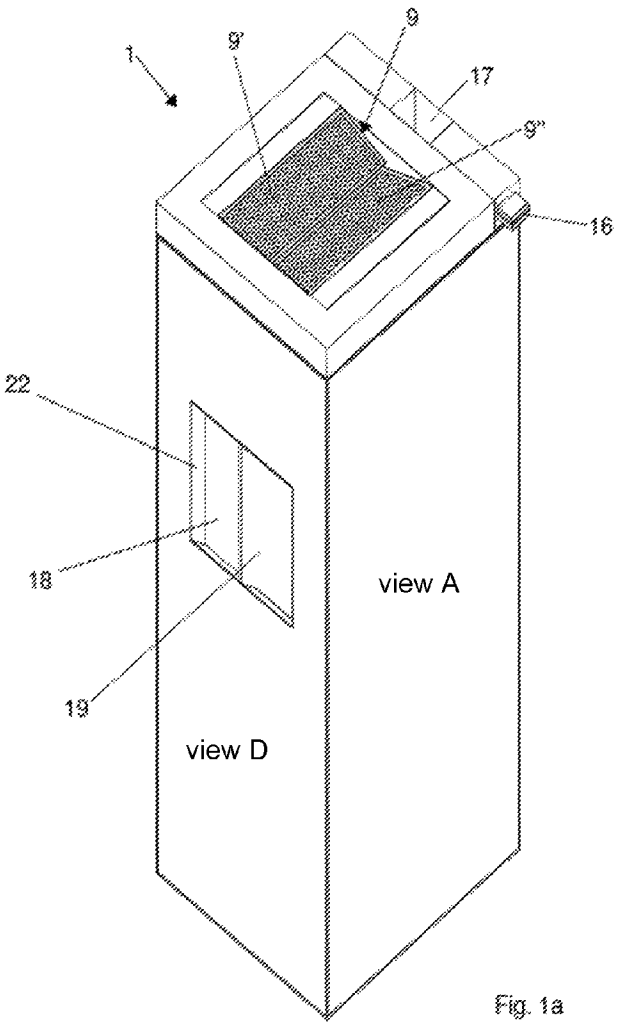

FIGS. from 5*a* to 5*d* show respective side views of the device of FIG. 1 from the inside.

The same reference numbers in the figures identify the same elements or components.

DETAILED DESCRIPTION OF PREFERRED EMBODIMENTS OF THE INVENTION

The figures show a preferred, but not exclusive embodiment of an ashtray device according to the invention, indicated with reference numeral 1 as a whole. Such a device comprises:

- a separation mechanism 2 for separating the ash from the butts
- and at least two containers 10, 11, wherein a first container 10 is positioned so as to receive the butts and the second container 11 is positioned so as to receive the ash.

In a preferred, but not exclusive variant, the separation mechanism 2 comprises:

- a conveyor belt 3 which can be actuated alternatively in a first direction X and then in a second direction Y, opposite to the first direction X,
- and a fixed separator element 4, arranged over said conveyor belt 3 and cooperating with the latter so that, when the conveyor belt 3 moves in the first direction X, the fixed separator element 4 allows the passage of the ash only and stops the butts.

Figure 4:
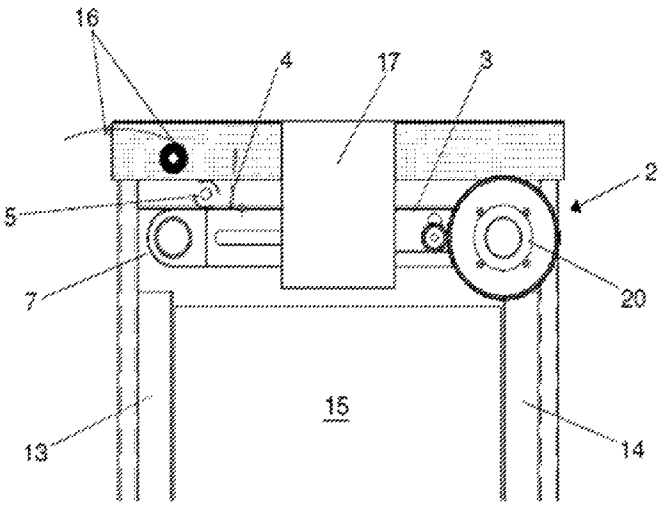
FIG. 4 is an enlargement of a side view of some components of the device of FIG. 1.
Figure 2:
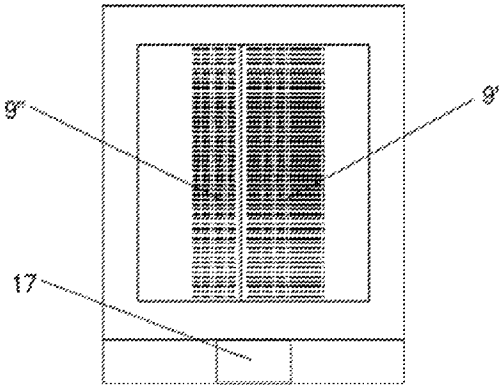
FIG. 2 is a top view of the device of FIG. 1.
Figure 3:
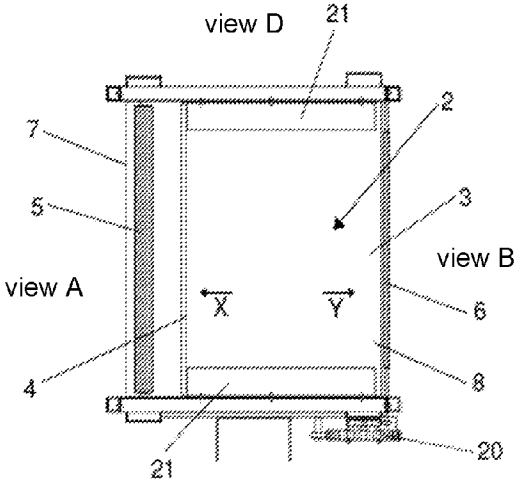
FIG. 3 is a top view of the device of FIG. 1 from the inside.
Figure 5B:
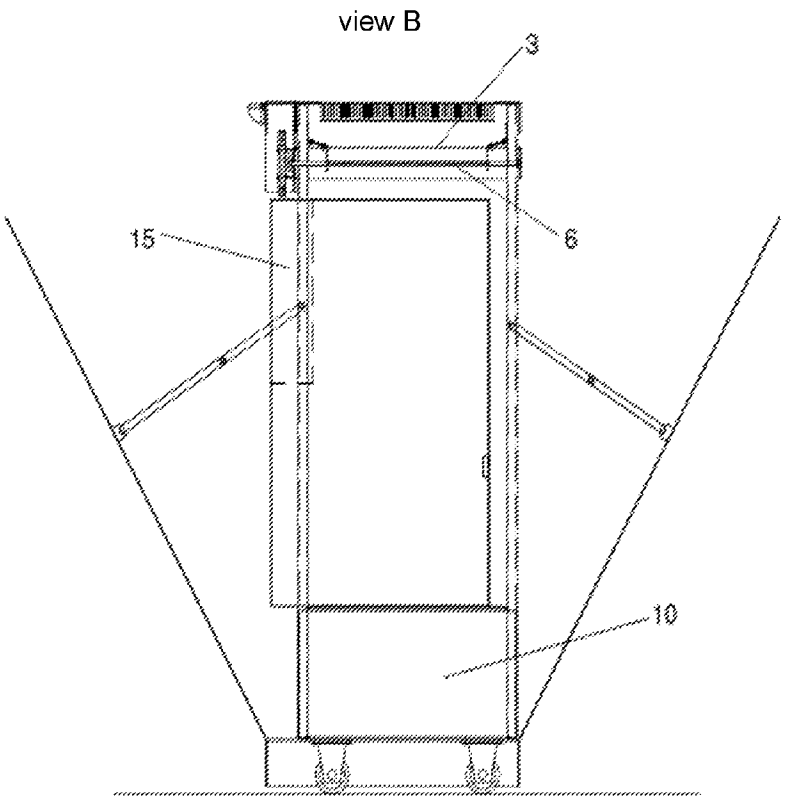
Figure 5A:
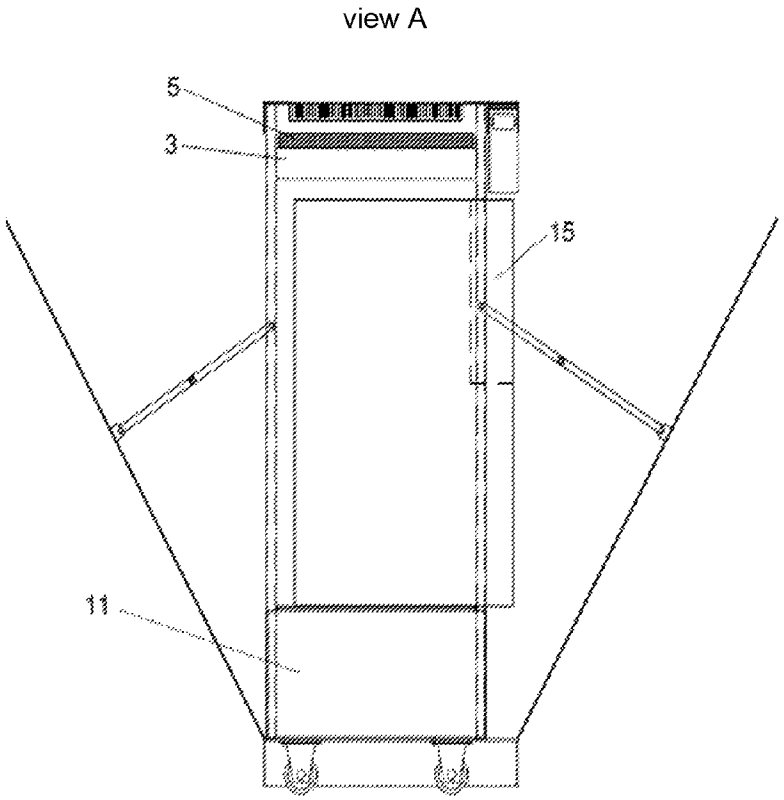
Figure 5D:
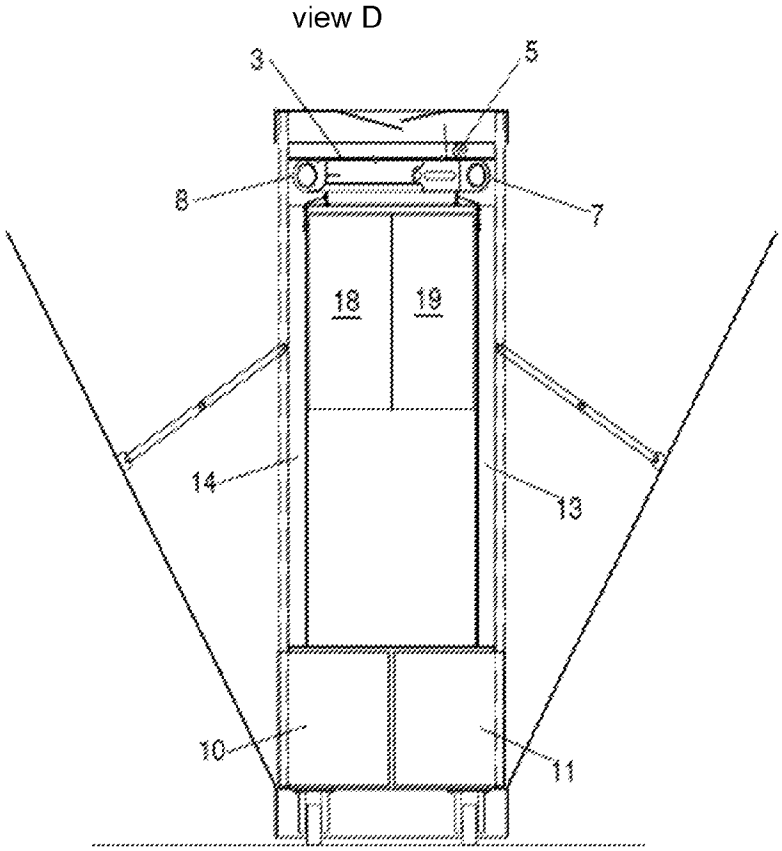
Figure 5C:
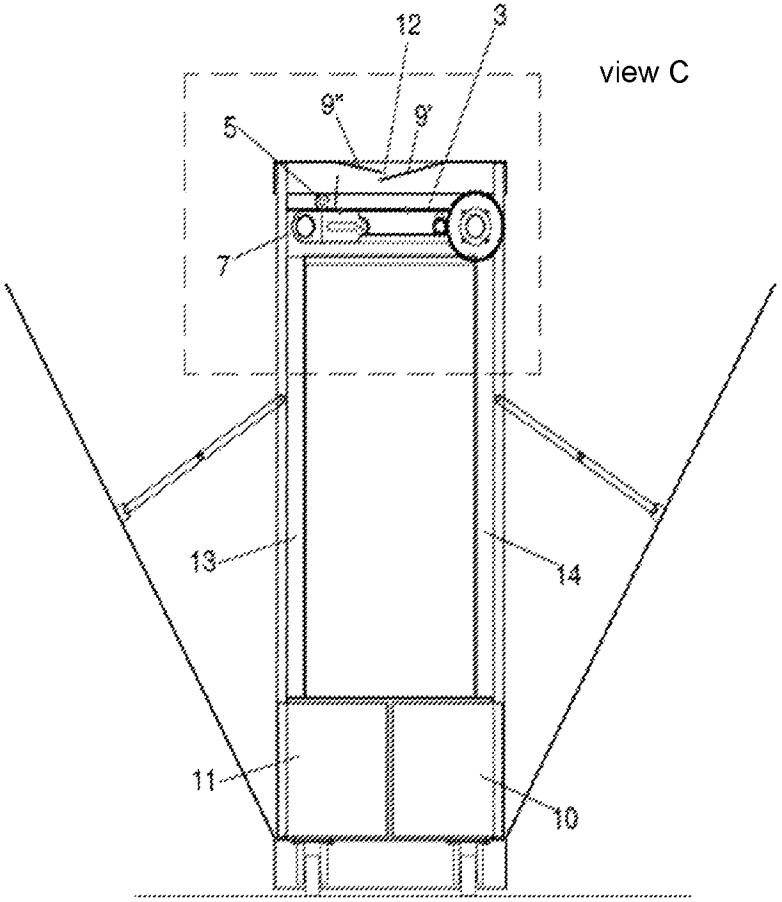

The separator element 4 can be, for example, a flat metallic sheet, preferably but not necessarily, made of steel, arranged transversely to the advancement plane of the belt 3. The metallic sheet is preferably but not necessarily substantially orthogonal to said advancement plane. The separator element 4 can be positioned near a first end 7 of the conveyor belt 3, over the belt 3, as shown in FIG. 4.

The conveyor belt 3 is actuated by means of transmission means 20, known in themselves, configured so as to transmit an alternating motion firstly in direction X and then in direction Y, after a given interval of time or following an input signal received from butt detection filters on the belt. The conveyor belt 3 is preferably but not necessarily a belt defining a closed path about two end rollers, actuated and tensioned by said two end rollers, of which at least one is a drive roller.

Advantageously, a first roller 5 is provided, cooperating with the conveyor belt 3, to crush the ash advancing towards the first end 7 of the conveyor belt 3, thus having an extinguishing function. The first roll 5 is arranged beyond the separator element 4 along said first direction X, near said first end 7. Said roller 5 may be positioned over the belt 3, as shown in FIG. 4, or arranged by the side of the belt.

A further advantage is in that a second roll 6 is provided, cooperating with the conveyor belt 3, so that when the belt 3 moves in the second direction Y, said second roller 6 crushes the butts, thus having the function of stubbing out the butts. The roller 6 is arranged beyond the separator element 4 along said second direction Y, preferably near a second end 8 of the conveyor belt 3, opposite to the first end 7. The roller 6 can also be positioned over the belt 3 or arranged by the side of the belt, as shown in FIG. 4.

Advantageously, the outer surface of the roller 6 can be notched so as to facilitate the crushing and the stubbing out of the butt.

An alternative variant can provide the use of only one of the two rollers 5, 6.

The rollers 5 and 6 can be made of steel or other fireproof material, for example a ceramic material.

A protective mask 9 which allows the passage of the butts either dropped or placed on it by a user, is provided over the separation mechanism 2.

In a preferred, but not exclusive variant, this protective mask 9 comprises two plates 9', 9" provided with a plurality of holes, said plates 9', 9" reciprocally converging towards a passage zone 12 of the butts.

Furthermore, vibrating means, known in themselves, are provided and suited to impart a vibration to the plates 9', 9" so as to facilitate the falling of the butt and of the ash on the conveyor 3 into the device, at regular intervals of time or following an input signal received from the detection sensors on the plate. Furthermore, side lead-ins or chutes 21, fixed to the structure of the device, which promote the collection of ash and butts towards the central zone of the conveyor belt 3 are provided at least at the perforated zone of the plates 9', 9" and of the passage zone 12.

Advantageously, an atomizing system for atomizing a perfumed solution onto the conveyor belt 3 and/or onto the protective mask 9 can be provided.

The structure of the ashtray device 1, object of the present invention, under the protective mask 9 and the separation mechanism 2, further includes:

- a first conveying channel 13, under the first end 7 of the belt 3, to receive and convey the ash towards the second container 11,
- a second conveying channel 14, under the second end 8 of the belt 3, to receive and convey the butts towards the first container 10.

The two conveying channels 13, 14, wide at least as the conveying belt 3, are arranged adjacent to two respective, mutually opposite side walls of the structure of the device 1, preferably parallelepiped-shaped.

In a preferred variant, the containers 11 and 10, for the separate collection of the ash and of the butts are arranged in the lower part of the structure under the respective conveying channels 13 and 14.

The conveying channels 13, 14 and the containers 11, 10 are preferably made of steel or other fireproof material.

In practice, the users can simply throw or stub out the cigarette or cigar butts on the mask 9. Such butts fall onto the conveyor belt 3 by gravity and/or by virtue of a vibration of the plates 9', 9" of the mask. The conveyor belt 3 is actuated for a short time moving firstly in direction X and then in direction Y at regular intervals or following an input signal received from butt detection sensors on the belt.

When the belt 3 moves in direction X, the butts are blocked by the fixed separator element 4, while the ash passes beyond said separator element 4, is crushed by the first roller 5 and then falls into the conveying channel 13 finally reaching the container 11.

When the belt 3 reverses its movement proceeding in direction Y, the butts arrive near the second end 8 and fall into the conveying channel 14 after having been crushed by the second roller 6. The butts thus reach the specific container 10.

Some brushes can be provided underneath the belt 3, at the two ends of the belt itself, to clean the surface of the belt, which turns upside down about the respective end roller of the belt itself, after having made the ash fall into the conveying channel 13 or the butts fall into the conveying channel 14.

Advantageously, at least one of the following components can be further provided between the conveying channels 13 and 14 and over the containers 10, 11, in a central zone of the structure of the ashtray device 1,

- a further container 18 for collecting paper;
- a further container 19 for collecting plastic and/or aluminum;
- a further container for collecting expired pharmaceuticals;
- a further container for collecting used batteries and/or light bulbs.

A side wall of the structure of the device has at least one access opening 22 for said further containers.

The four side walls of the structure of the device according to the invention are all openable, for example in the manner shown in FIGS. from 5*a* to 5*d*, to guarantee access to all containers and for possible maintenance operations.

Each container present inside the device 1 is preferably lined on the inside with a paper and/or biodegradable plastic bag.

The collection bags, rapidly made of biodegradable material, generally of paper lined with a biodegradable plastic material film of organic origin, are designed to be directly sent to the recycling process without needing intermediate steps.

Indeed, their biodegradability feature and recycling predisposition allows a rapid separation of the material of the bag from its contents so as to send the various material to the various recovery/treatment lines.

A further advantage is in that the structure of the device comprises at least one disposable tissue dispenser 16, a slot 17 for disposing of chewing-gum and/or sweets, and a further container 15 for receiving chewing-gum and/or sweets falling from said slot 17.

The slot 17 can be provided, for example, in the upper plane of the device at one of the edges, and the corresponding container 15 is preferably positioned under said slot 17 and, for example, in front of the pair of containers 18, 19 for paper and plastic/aluminum or in front of a single container for collecting expired pharmaceuticals. The latter solution must be used, in particular at pharmacies or chemists.

A user needing to dispose a chewing-gum, for example, may pull out a tissue from the dispenser 16 into which placing the chewing-gum and then throw the tissue into the slot 17. This precaution thus permits to at least partially reduce the unsightly problem of chewing-gums on sidewalks, which are crushed by unwitting passers-by with consequent inconvenience.

By way of non-limiting example, the device 1 is rectangular parallelepiped shaped and is provided with two retractable wheels.

At least one of the following components can be integrated in its structure:

- steel brushes for self-cleaning, with possible self-cleaning cycle after an interval of time which is programmable by means of a timer;
- fire sensors;
- automatic separation mechanism start-up sensors;
- GPS positioning device;
- electric power battery;
- photovoltaic panel for recharging the battery or alternatively, common electric recharging means;
- container filling indicator sensor;
- programmable switch-off timer, e.g. at the end of the day.

The invention claimed is:

1. An ashtray device for collecting cigarette or cigar ash and butts, the device comprising:

- a separation mechanism for separating the ash from the butts and at least two containers, wherein a first container is positioned so as to receive the butts and the second container is positioned so as to receive the ash, the ashtray device being characterized in that said separation mechanism comprises:
- a single conveyor belt actuated alternatively, in a first direction and then in a second direction which is opposite to the first direction; and
- a fixed separator element arranged over said conveyor belt and cooperating therewith so that, when the conveyor belt moves in said first direction, the fixed separator element stops the butts and lets the ash pass through and reach said second container, whereas, when the conveyor belt moves in said second direction, the butts reach said first container.

2. The device according to claim 1, wherein said fixed separator element is positioned in proximity of an end of the conveyor belt.

3. The device according to claim 2, wherein there is provided a roller cooperating with the conveyor belt to crush the ash advancing towards said end of the conveyor belt, the roller being arranged beyond the fixed separator element along said first direction.

4. The device according to claim 2, wherein there is provided a roller cooperating with the conveyor belt so that the roller crushes the butts when the conveyor belt moves in said second direction.

5. The device according to claim 4, wherein the roller is arranged beyond the fixed separator element along said second direction.

6. The device according to claim 1, wherein a protective mask is provided over the separation mechanism, which allows the passage of the butts either dropped or placed on said protective mask by a user.

7. The device according to claim 6, wherein vibrating means are provided to periodically vibrate said plates.

8. The device according to claim 1, wherein there are provided, in proximity of ends of the conveyor belt, respective conveying channels to convey the ash towards the second container and the butts towards the first container, respectively.

9. The device according to claim 1, wherein the structure of the device comprises a disposable tissue dispenser, a slot for disposing of chewing-gums and/or sweets, and a third container to receive said chewing-gums and/or sweets.

10. The device according to claim 3, wherein the roller is arranged in proximity of said end of the conveyor belt.

11. The device according to claim 5, wherein the roller is arranged in proximity of an end of the conveyor belt.

12. The device according to claim 5, wherein the roller is provided with a notched surface.

13. The device according to claim 6, wherein said protective mask comprises two plates provided with a plurality of holes, said plates converging towards a passage zone of the butts.

14. The device according to claim 9, wherein at least one of the following components is provided:

a fourth container for collecting paper;

a fifth container for collecting plastic and/or aluminum;

a sixth container for collecting expired pharmaceuticals;

a seventh container for collecting used batteries and/or light bulbs; and an atomizing system for atomizing a perfumed solution onto the conveyor belt and/or onto a protective mask.

15. The device according to claim 1, wherein the separation mechanism includes a transmission means configured to transmit an alternating motion to the conveyor belt in the first direction and then in the second direction.

16. The device according to claim 15, wherein the transmission means alternates direction of the conveyor belt after a predetermined time.

17. The device according to claim 15, wherein the transmission means alternates direction of the conveyor belt after receiving an input signal from a sensor device configured to detect the butts on conveyor belt.

* * * * *